US006988906B1

(12) United States Patent
Chen

(10) Patent No.: US 6,988,906 B1
(45) Date of Patent: Jan. 24, 2006

(54) FLUORESCENT LAMP TUBE SEAT

(76) Inventor: Chuan-Ying Chen, No. 27, Lane 299, Hsi Men St., Hsinchu City (TW)

( * ) Notice: Subject to any disclaimer, the term of this patent is extended or adjusted under 35 U.S.C. 154(b) by 0 days.

(21) Appl. No.: 11/115,140

(22) Filed: Apr. 27, 2005

(51) Int. Cl.
*H01R 33/02* (2006.01)

(52) U.S. Cl. ..... 439/226

(58) Field of Classification Search ..... 439/226, 439/619, 236, 232, 350, 441, 228, 240–241; 200/51.07, 51.09; 313/318.01, 318.04, 318.08, 313/318.12

See application file for complete search history.

(56) References Cited

U.S. PATENT DOCUMENTS 3,401,242 A * 9/1968 McLaughlin ..... 200/51.07
3,906,275 A * 9/1975 Spiessens et al. ..... 313/318.12
5,855,487 A * 1/1999 Kunishi ..... 439/232
6,008,570 A * 12/1999 Helbig et al. ..... 313/318.01
6,364,679 B1 * 4/2002 Gerstberger ..... 439/241
6,733,316 B1 * 5/2004 Chen ..... 439/232

* cited by examiner

*Primary Examiner*—J. F. Duverne
(74) *Attorney, Agent, or Firm*—Leong C. Lei

(57) ABSTRACT

A fluorescent-lamp tube seat is disclosed. The seat is characterized in that the interior of the seat body is provided with a chamber and the interior panel of the seat body is a vertical slot allowing upward and downward movement of the pins of the fluorescent-lamp tube, the sliding block has an upper end provided with a sliding slot and one side of the sliding block is extended to form a lower blocking section which is restricted to reciprocating movement at one side of the vertical slot, and the lifting member is corresponding to the end of the sliding block and is extended downward to form a braking rod and the two sides of the bottom section of the braking rod are formed into a left and right sloping face which allow to be pushed and engaged at a high and low position of the upper section of the sliding block, and the two conductive plates being bent inwardly to form protruded sections and the two protruded sections of the conductive plates are arranged in alternately at the two sides of the vertical slots.

3 Claims, 5 Drawing Sheets

FLUORESCENT LAMP TUBE SEAT

BACKGROUND OF THE INVENTION (a) Technical Field of the Invention

The present invention relates to a seat structure, and in particular, a seat structure for mounting a fluorescent lamp tube.

(b) Description of the Prior Art

Taiwanese Utility Model Application No. 92206024 (Publication No. 566717) entitled "An Improved Structure of a Fluorescent Lamp Tube Seat" discloses a seat allowing a fluorescent lamp tube to be mounted thereon by pushing the tube towards the seat and then releasing the tube. The tube is secured at the conductive position of the seat. To unload the tube, the tube is pushed again and released. The tube is loaded. However, when the conductive copper plates are deformed or when the light tube shakes, the support may be insufficient. In addition, the conventional seat does not allow for the mounting of T5 lamp tube and T8 light tube.

SUMMARY OF THE INVENTION

The primary purpose of the present invention is to provide a fluorescent-lamp tube seat with a seat body, a sliding block, a lifting structure and two conductive plates mounted within the interior of the seat body, characterized in that the interior of the seat body is provided with a chamber and the interior panel of the seat body is a vertical slot allowing upward and downward movement of the pins of the fluorescent-lamp tube, the sliding block has an upper end provided with a sliding slot and one side of the sliding block is extended to form a lower blocking section which is restricted to reciprocate movement at one side of the vertical slot, and the lifting member corresponds to the end of the sliding block and is extended downward to form a braking rod and the two sides of the bottom section of the braking rod are formed into a left and right sloping face which is allowed to be pushed and engaged at a high and low position of the upper section of the sliding block, and the two conductive plates are bent inwardly to form protruded sections and the two protruded sections of the conductive plates are arranged in alternately at the two sides of the vertical slots.

Yet still another object of the present invention is to provide a fluorescent lamp tube seat, wherein the side end of the sliding block is extended to form an upper and a lower blocking sections.

Still a further object of the present invention is to provide a fluorescent lamp tube seat, wherein the height of the top edge of the upper and lower blocking sections of the side end of the sliding block is between the range of the protruded surface of the conductive plates.

Yet another object of the present invention is to provide a fluorescent lamp tube seat, wherein the lifting member opposite to one end of the braking rod supplements a straight rod section such that when the lifting member is engaged at the lower position, the bottom end of the straight rod section exposes one section of the bottom edge of the seat body.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
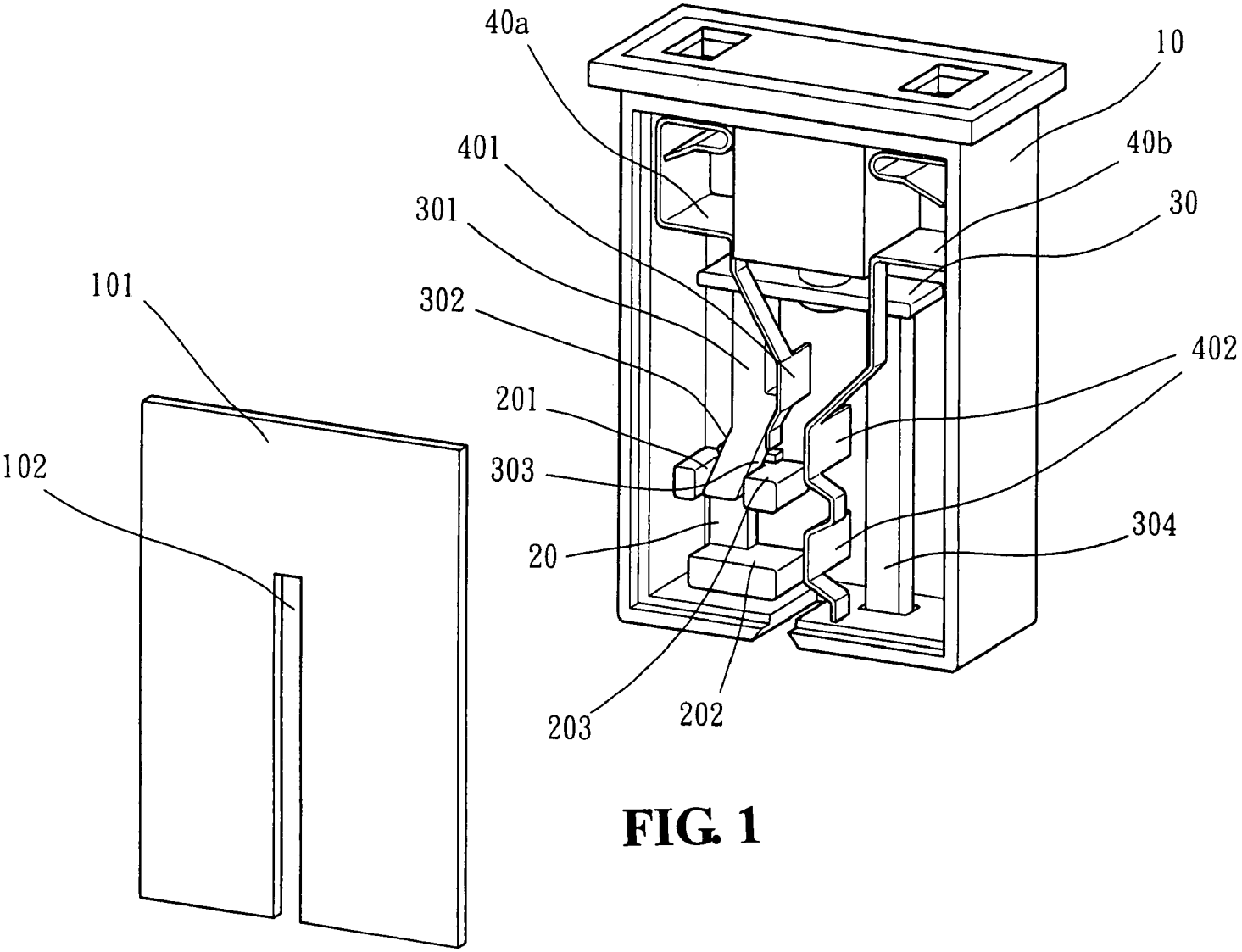
FIG. 1 is a perspective view showing the interior structure of the fluorescent lamp tube seat of the present invention, wherein the cover of the seat is detached from the seat.
Figure 3:
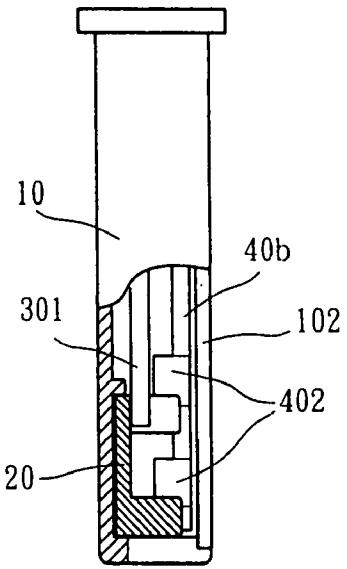
FIG. 3 is a partial sectional view of the fluorescent lamp tube seat of the present invention.
Figure 2:
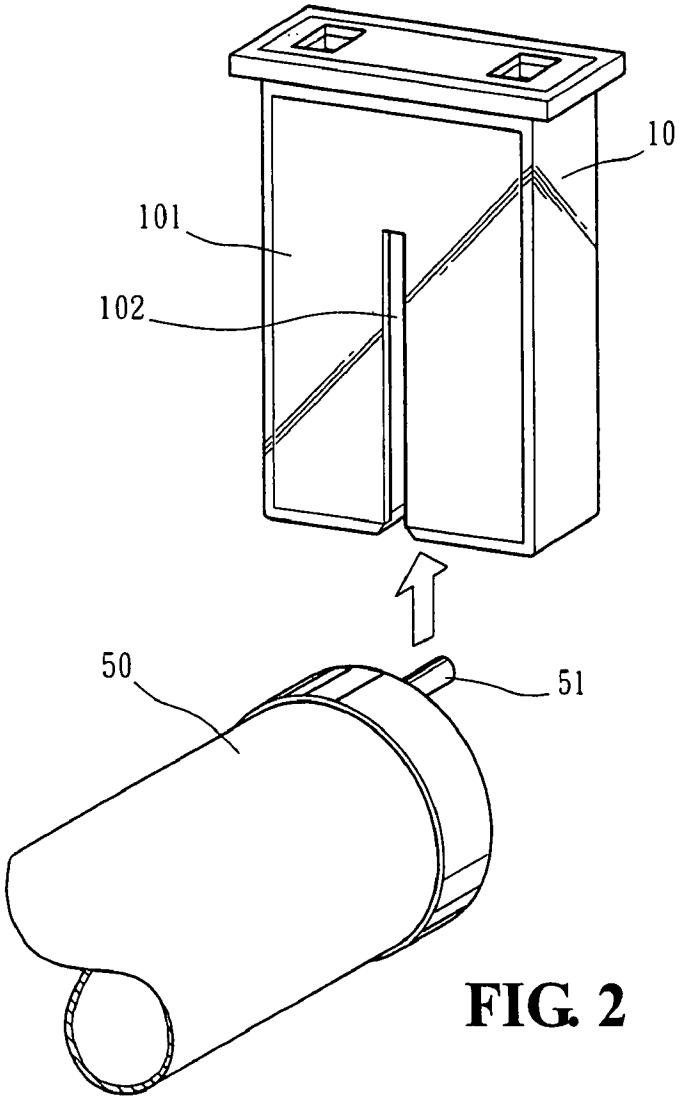
FIG. 2 is a perspective view showing the mounting of a fluorescent lamp tube onto the seat of the present invention.
Figure 8:
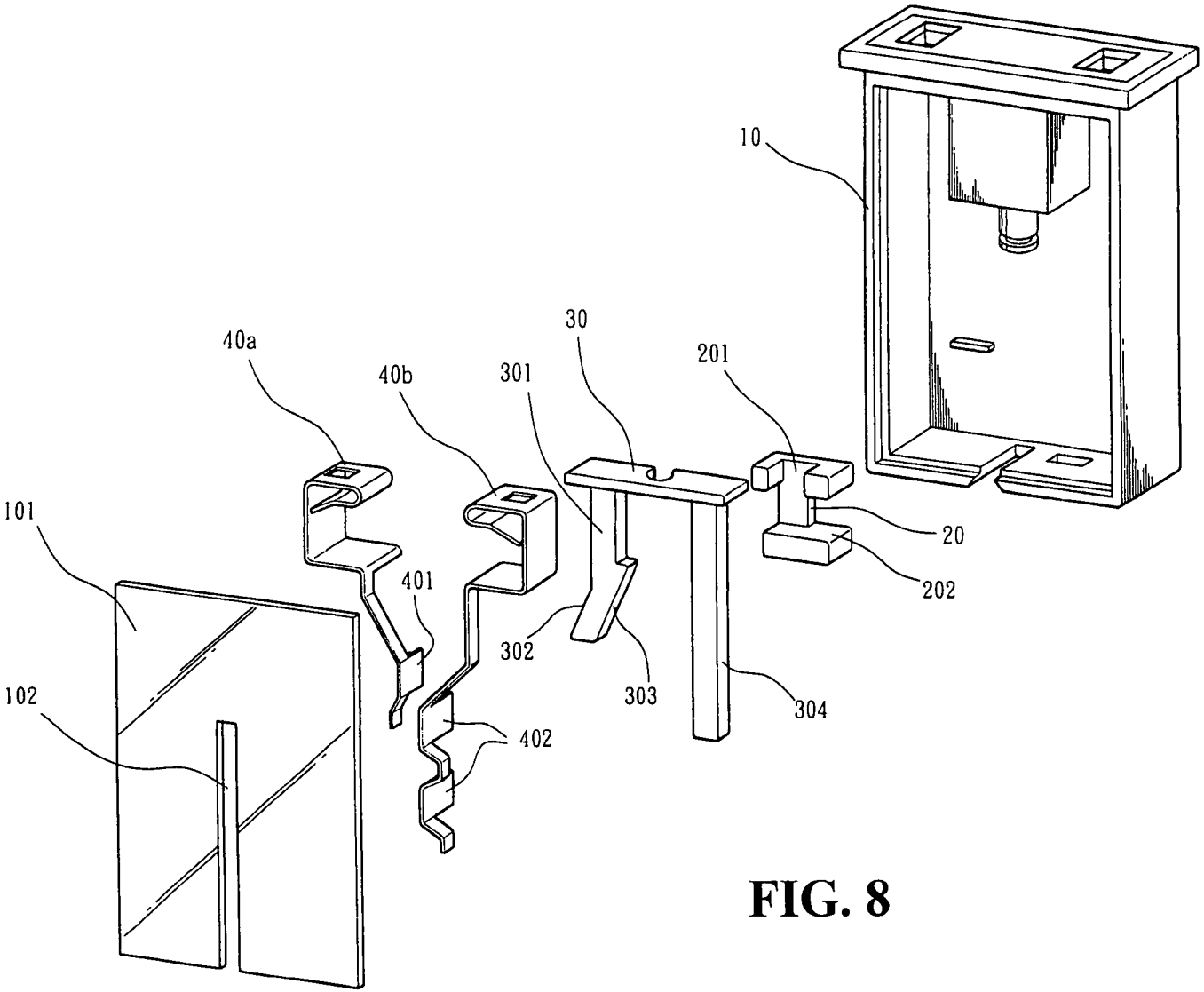
FIG. 8 is an exploded perspective view of the fluorescent lamp tube seat in accordance with the present invention.

Referring to FIGS. 1, 2, and 8, there is shown a fluorescent-lamp tube seat structure which substantially includes a seat body 10, a sliding block 20, a lifting member 30, two conductive plates 40*a*, 40*b* mounted within the interior of the seat body 10. The interior of the seat body 10 is provided with a chamber for holding other components, and the interior panel 101 of the seat body 10 is provided with a vertical slot 102. The width of the slot 102 is slightly larger than the diameter of the pin 51 of the light tube 50 of T8 (light tube) such that the pin 51 will not slide in a sloping position within the slot.

The upper end of the sliding block 20 has a sliding slot 201 and the side end is extended to form a moving block having a lower blocking section 202 so as to restrict the horizontal reciprocation to be within one side of the vertical slot 102.

The lifting member 30 is reciprocated and engaged at the upper position of an engaging blocking member 20 at the high and low position and the corresponding sliding block is extended to form a braking rod 301. The two sides of the bottom section of the braking rod 301 are formed into a left and right sloping face 302, 303.

The two conductive plates 40*a*, 40*b* have a bottom sections inwardly bent to form a protruded sections 401, 402, and the protruded sections 401, 402 are arranged alternatively at the two sides of the vertical slots 102.

Figure 5:
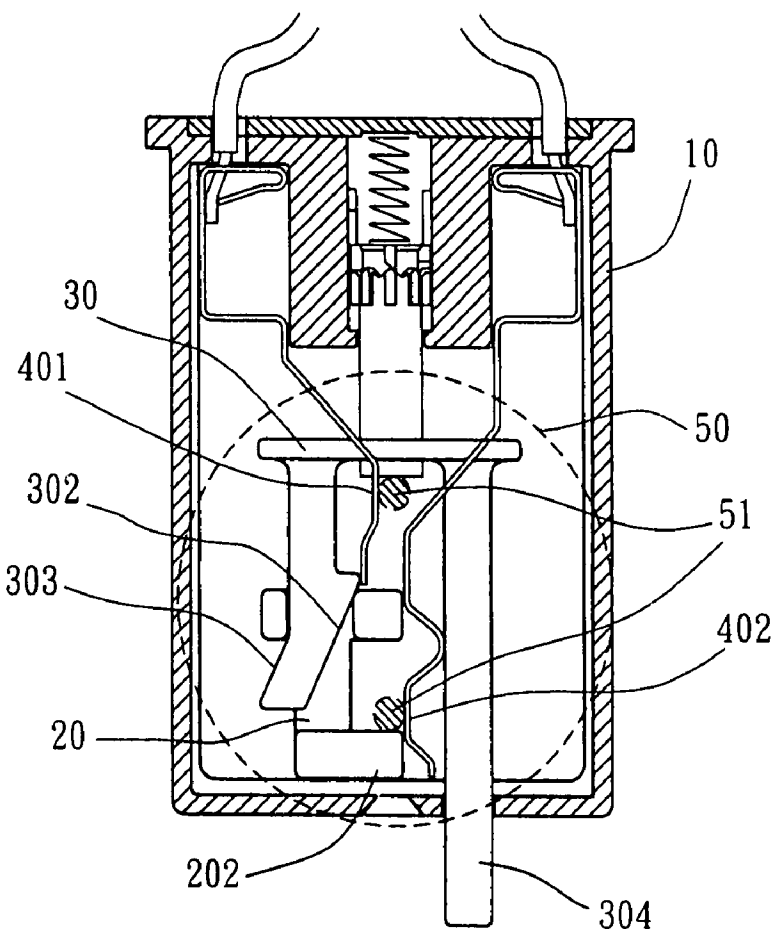
FIG. 5 is a schematic view showing the completion of the mounting of the T8 fluorescent lamp tube onto the seat of the present invention.
Figure 4:
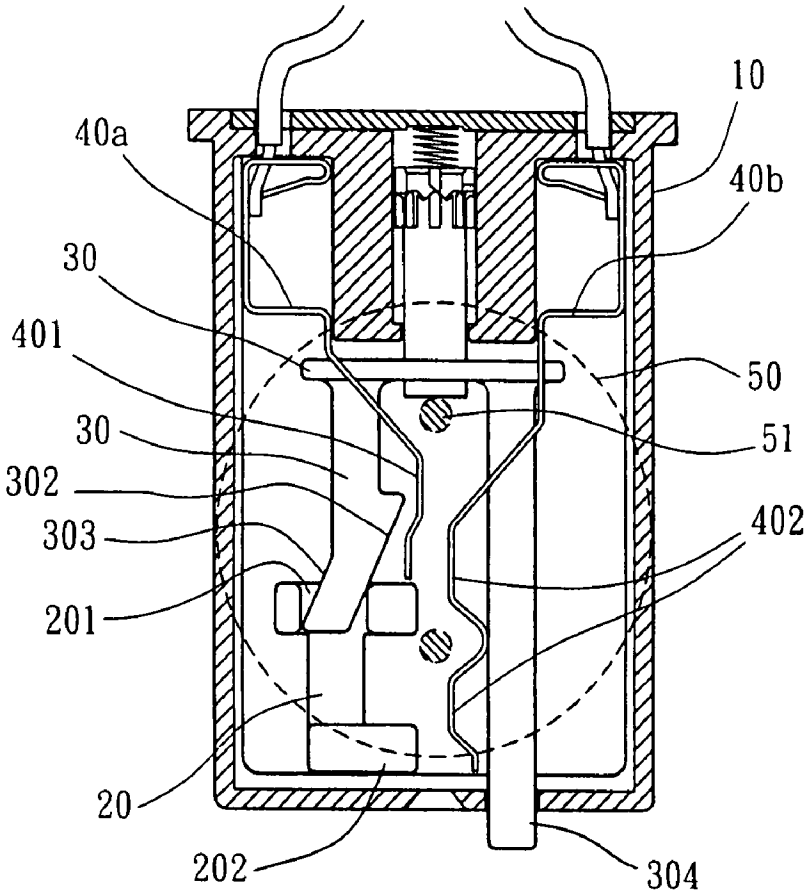
FIG. 4 is a schematic view showing the mounting of a T8 fluorescent lamp tube onto the seat of the present invention.

As shown in FIG. 4, when the lifting member 30 is engaged at the high position, and the braking rod 301 is driven to the high of the sliding slot 201. The sliding block 20 is engaged at the vertical slot 102 which will not deter the movement of the pin 51. As shown in FIG. 5, when the lifting member 30 is engaged at the low position, the sliding block 20 engages at the wall of the sliding slot 201 by the right sloping face 303 of the braking rod 301 and the sliding block is horizontally engaged at the exit position of the vertical slot 102, and the height of the top edge of the lower position 202 of the sliding block is within the range of the protruded section surface 402 of the conductive plate 40*b*.

The two seats are mounted at an interval of the length of the fluorescent-lamp tube. The lifting member 30 is at the upper position and the two conductive plates 40*a*, 40*b* are respectively connected to the positive and negative terminal. When the tube is mounted as shown in FIGS. 2 and 4, the two pins 51 at the end of the T8 light bulb 50 are inserted into the vertical slot 102. As shown in FIG. 5, the pins 51 are movingly mounted at the lower position and the lifting member 30 moves in accordance with the pins 51. The right sloping face 303 is stopped at the blocking member 20 to move horizontally to the vertical slot 102 so that the lower blocking section 202 blocks the opening at the bottom section of the vertical slot 102, and the pins 51 are respectively in contact with the protruded sections 401, 402 of the two conductive plates and are firmly mounted at the seat body. When the T8 light tube 50 is pushed once and is released, the lifting member 30 is engaged at the upper or higher position by the movement of the pins 51. At the same time, the left sloping face 302 engages the sliding block 20 to move opposite to the end of the vertical slot 102, and the light bulb is directly unload from the seat body.

Figure 7:
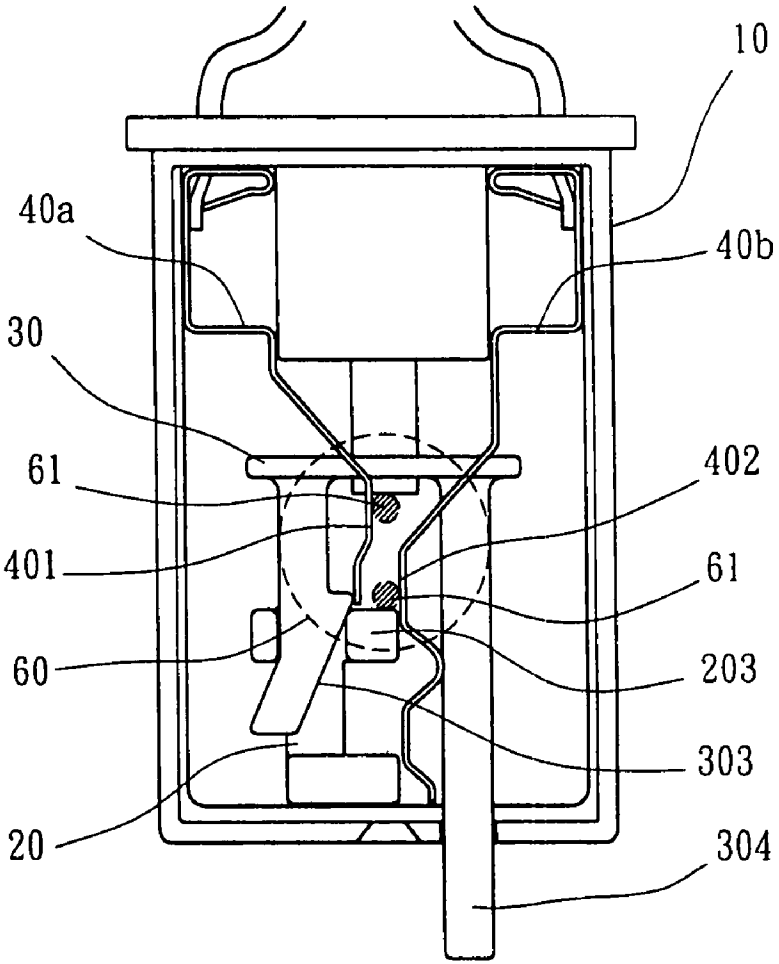
FIG. 7 is a schematic view showing the completion of the mounting of T5 fluorescent lamp tube onto the seat of the present invention.
Figure 6:
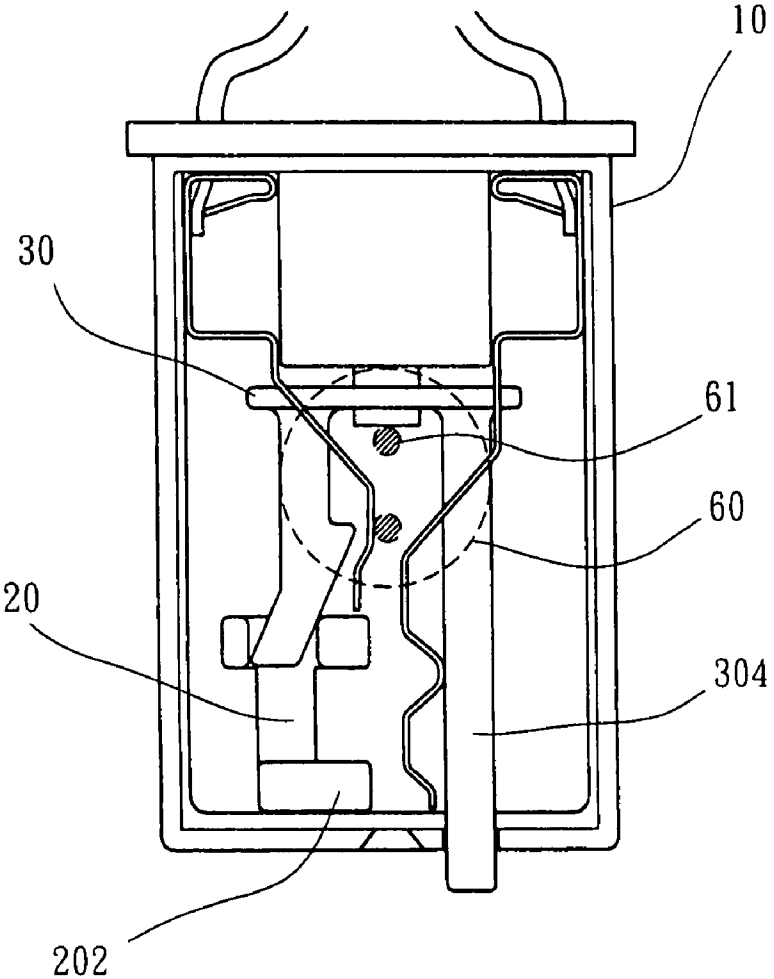
FIG. 6 is a schematic view showing the mounting of a T5 fluorescent lamp tube onto the seat of the present invention.

Referring to FIGS. 6 and 7, the same side of the lower blocking section 202 of the sliding block 20 can at the same time is formed into the upper blocking section 203. The height of the top edge of the upper and lower blocking sections 202, 203 is within the range of the protruded surface 402 of the conductive plate 40*b*. Accordingly, when the pins 61 of the smaller diameter T5 light bulb 60 pushes the lifting member 30 from the upper position to the lower position, the upper blocking section 203 of the sliding block will first to move horizontally to block the lower section of the pin 61, and the pin 61 of the T5 light tube is secured firmly to engage at the protrusion position 401, 402 of the two conductive plates and the seat of the present invention is applicable for the mounting of T5 light tube and T8 light tube.

As shown in FIGS. 4, 5, 6 and 7, the lifting member 30 at one end opposite to the braking rod 301 is supplemented a straight rod section 304, and when the lifting member engages at the lower position, the bottom end of the straight rod section 304 exposes a section of the bottom edge of the seat body 10, facilitating the user to recognize the exact position of the sliding block 20, and facilitating the user to push the exposed section of the straight rod so as to move the lifting member 30 to engage at the upper position to allow the pins 51, 61 of the T5 or T8 light tube to enter the vertical slot smoothly.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A fluorescent-lamp tube seat having a seat body, a sliding block, a lifting member and two conductive plate mounted within the interior of the seat body, characterized in that the interior of the seat body is provided with a chamber and the interior panel of the seat body is a vertical slot allowing upward and downward movement of the pins of the fluorescent-lamp tube, the sliding block has an upper end provided with a sliding slot and one side of the sliding block is extended to form a lower blocking section which is restricted to reciprocating movement at one side of the vertical slot, and the lifting member corresponds to the end of the sliding block and is extended downward to form a braking rod and the two sides of the bottom section of the braking rod forms into a left and right sloping face which is allowed to be pushed and engaged at a high and low position of the upper section of the sliding block, and the two conductive plates are bent inwardly to form protruded sections and the two protruded sections of the conductive plates are arranged in alternately at the two sides of the vertical slots.

2. The fluorescent-lamp tube seat of claim 1, wherein the side end of the sliding block is extended to form an upper and a lower blocking sections.

3. The fluorescent-lamp tube seat of claim 1, wherein the lifting member opposite to one end of the braking rod supplements a straight rod section such that when the lifting member is engaged at the lower position, the bottom end of the straight rod section exposes one section of the bottom edge of the seat body.

* * * * *